343-754 SR
11/16/82 OR 4,359,741

United States Patent [19]

Cassel

[11] 4,359,741

[45] Nov. 16, 1982

[54] LENS ANTENNA ARRANGEMENT

[75] Inventor: Knut E. Cassel, Jarfalla, Sweden

[73] Assignee: U.S. Philips Corporation, New York, N.Y.

[21] Appl. No.: 144,728

[22] Filed: Apr. 28, 1980

Related U.S. Application Data

[63] Continuation-in-part of Ser. No. 118,814, Feb. 5, 1980, Pat. No. 4,309,710.

[30] Foreign Application Priority Data

Feb. 6, 1979 [SE] Sweden ..... 7901046

[51] Int. Cl.[3] ..... H01Q 19/06

[52] U.S. Cl. ..... 343/754; 343/755; 343/911 L

[58] Field of Search ..... 343/754, 755, 854, 909, 343/910, 911 R, 911 L

[56] References Cited

U.S. PATENT DOCUMENTS

| | | | |
|---|---|---|---|
| 3,116,485 | 12/1963 | Carson | 343/754 |
| 3,922,681 | 11/1975 | Lewis | 343/909 |
| 3,958,247 | 5/1976 | Bogner et al. | 343/754 |
| 4,297,709 | 10/1981 | Cassel et al. | 343/754 |
| 4,309,710 | 1/1982 | Cassel | 343/754 |

*Primary Examiner*—David K. Moore
*Attorney, Agent, or Firm*—Robert J. Kraus

[57] ABSTRACT

An antenna, preferably operating in the microwave range, comprising a Luneberg lens with a disc having a radially varying refraction index and provided with feeders distributed around the circumference. Each feeder has the shape of a thin wire the projection of which, as seen radially relative to the center of the round disc, forms a straight line inclined 45° against the plane of the disc. All feeders are inclined in the same direction in their respective radial planes, whereby the feeders opposite a respective feeder will be oriented substantially perpendicular to the feeder permitting passage of radiation to and from the feeder. All of the feeders can be active simultaneously.

6 Claims, 5 Drawing Figures

LENS ANTENNA ARRANGEMENT

CROSS REFERENCE TO RELATED APPLICATION

This application is a continuation-in-part of copending application Ser. No. 118,814 filed Feb. 5, 1980, which issued as U.S. Pat. No. 4,309,710 on Jan. 5, 1982.

BACKGROUND OF THE INVENTION

The invention relates to a lens antenna arrangement, preferably for operation; within the microwave range. The arrangement comprises a round disc-shaped lens element, for example a round disc of dielectric plastic material with radially varying refractive index. The lens element has, on at least one of the major sides, a conductive plane and is surrounded by radiators or feeders located at the circumference for reception and transmission of electromagnetic energy passing through the disc-shaped lens element.

Known antennas of this kind are either constructed for a polarization with the E-vector perpendicular to the plane of the lens antenna or a polarization with the E-vector situated in the plane of the lens. If the lens antenna is oriented horizontally the former polarization can be called vertical and the latter horizontal polarization.

It is advantageous if the lens antenna is stationary but nevertheless usable for reception or transmission in different directions by using several feeders situated at different places along the circumference. However, if feeders are arranged along the whole circumference the problem arises, if special measures are not taken, that feeders situated at the opposite half of the circumference relative to a respective feeder may act as attenuators for radiation to or from the respective feeder. In order to avoid this, each feeder must have a small geometrical projection surface as seen in a plane which is perpendicular to the direction of the radiation to or from a respective feeder. Besides the geometrical extension in said plane it is also possible to define an "effective antenna area" for each feeder in said plane which must also be small if the feeders are not to act as strong attenuators. This effective antenna area depends i.a. on the load impedance of the feeder and can be varied by electrical switching operations.

In previously proposed antenna constructions having feeders distributed around the circumference thereof one single feeder is used at a time. Those feeders, which would act as attenuators for the radiation to or from the active feeder are switched electrically so that their effective antenna area is small. This means of course, that these feeders cannot be used either as receiving or transmitting elements as long as they must have a small attenuating effect.

SUMMARY OF THE INVENTION

An object of the invention is a provide a lens antenna arrangement, of the above-described kind, in which the lens antenna can in a simple manner, be selectively activated for reception or transmission in any direction and in any desired lobe without moving the antenna or making any switching actions in order to change the impedance or damping effect of the feeders.

According to the invention this is achieved by providing directive dipole feeders around the lens element circumference. The dipole feeders are shaped such that each feeder has a limited lobe directed diametrically through the lens element, and that each dipole feeder is located in a plane which is inclined approximately 45° relative to the lens plane. The feeders—as seen radially for each individual feeder—are inclined in the same direction so that each feeder is sensitive to an electromagnetic wave or transmits a wave, respectively, which is polarized substantially orthogonally relative to the plane of the feeder situated at the central part of the opposite half of the lens circumference. Switching means is electrically connected between the feeders and a receiver and/or transmitter, for selectively activating one feeder or group of feeders, as desired.

Because opposite feeders lie in planes which are substantially perpendicular to the polarization direction of the radiation to or from each other, the opposite feeders will not have any substantial damping effect on said radiation. Thus it is possible to activate any feeder for reception or transmission in any direction, and by the successive activation of adjacent feeders in a time sequence the lobe can be made to sweep around the circumference. It is also possible to activate a group of adjacent feeders simultaneously in order to increase the effective lobe width and even to activate all feeders simultaneously.

The radiation from such a lens antenna according to the invention will be polarized 45° relative to the antenna plane, which is usually horizontal, and in many applications it may be an advantage to have an antenna operating with radiation polarized 45° due to the fact that in this case a component is present both in horizontal and vertical direction. The advantage of being able to simultaneously and without switching receive and transmit, in both polarization directions is offset by only a small (3 dB) decrease in the antenna gain factor as compared with an antenna which can only be switched between vertical or horizontal polarization.

In order to ensure that the component which is parallel with the plane of the lens or the horizontal component can pass through the lens, it is necessary that the distance between the conductive planes is larger than half of the wave length for the actual radiation. The distance therefore must be larger than half of the wave length for the lowest frequency. If the lens shall have a desired focusing effect, it is furthermore necessary that the distance between the conductive metal planes is essentially larger than half of the wave length at the lowest frequency. In order to reduce the total thickness of the lens, i.e. the distance between the conductive planes, and to achieve the advantages resulting from a small lens thickness a part of the distance between the conductive planes may consist of air or a dielectricum with corresponding dielectric constant, as described in the Swedish patent application 7901047-6 which corresponds to U.S. Pat. No. 4,297,709.

Theoretically only one single feeder is situated exactly perpendicular to the E-field of the wave from a respective feeder, namely that feeder which is situated exactly diametrically opposite the feeder. The remaining feeders on the opposite side have an inclination against the E-field vector which deviates from 90°, the deviation from 90° increasing with the distance to the diametrically situated feeder. The feeders situated at the outermost parts of the opposite half of the round disc-shaped element therefore will have an attenuating influence on the radiation from the respective feeder.

Because of the attenuating influence, it is important to restrict the lobe width so that the lobe of each feeder only covers the central part of the opposite half of lens circumference. Thus the dipole must be shaped such that it is highly directive and has a lobe of small width. A very simple way to achieve this is to choose as the feeder a generally V-shaped dipole, having its apex directed outwardly from the lens circumference.

If conductive planes are arranged at both major sides of the lens element it is desirable according to another feature of the invention, that the free ends of the V-shaped dipole feeders are electrically coupled to each conductive plane. If this is done there will be no reflections at the free ends of the dipole but the currents at said ends will flow into the conductive planes. This has two effects. First of all it lowers the lower limit frequency and thereby broadens the operation frequency band and secondly it decreases the back lobe radiation.

Preferably each feeder is of substantially symmetric shape in its plane, a line through the apex of the V forming a symmetry line, and feeding being effected in the apex. This causes strong supression of higher modes (all modes having a minimum at the center are suppressed due to the geometrically symmetric feeding).

More specifically the legs of the V should be of concave shape as seen from the outside of the V and preferably they are bent to an exponential curve substantially satisfying an equation:

$$y = \pm A \cdot e^{px}$$

where y is the distance from the symmetry line through the apex of the V to the respective leg, x is the distance along the symmetry line from the apex and A and p are constants. A then determines the gap at the central feeding point of the dipole and p determines the "slope" of the legs. It has been proved that this form of the dipole gives excellent results as regards strong directive action with a restricted lobe of small width and high suppression of higher modes and back lobe radiation.

BRIEF DESCRIPTION OF THIS DRAWING

The invention is described more closely by means of example with reference to the drawing, in which.

DESCRIPTION OF THE PREFERRED EMBODIMENT

Figure 1:
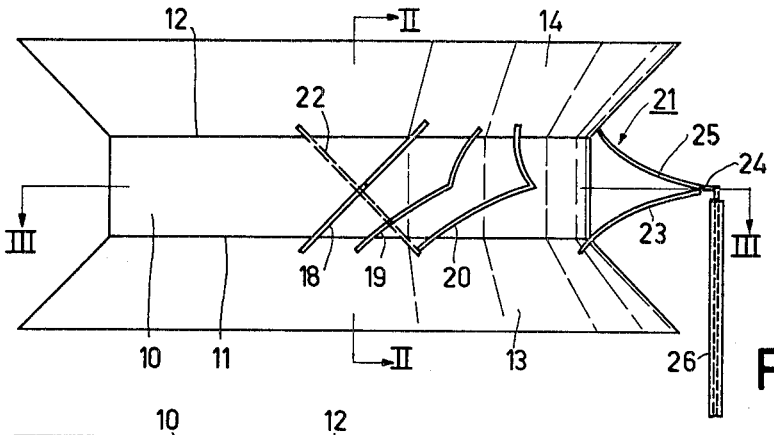
FIG. 1 shows a schematic side view of a lens antenna of Luneberg-type according to the invention, in which for the sake of clearness only a few feeders are shown.
Figure 2:
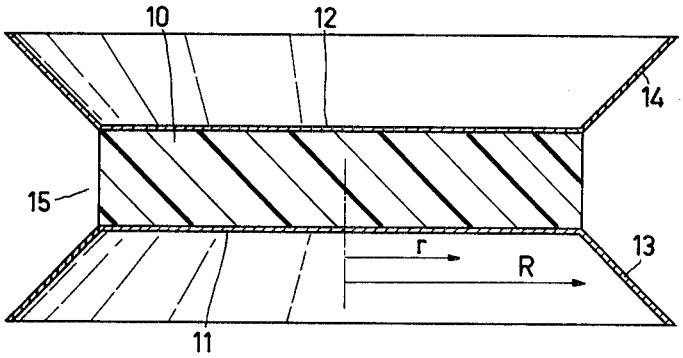
FIG. 2 shows a vertical sectional view through the antenna of FIG. 1 taken along the line II—II, the feeders being omitted.

The lens antenna shown includes of a circular disc 10 of dielectric material having a refractive index (dielectric constant) which increases toward the center of the disc causing a corresponding increase in the delay of electromagnetic radiation. The antenna also includes two round metallic plates 11 and 12 situated on each side of the disc 10. At the circumference each metallic plate 11, 12 continues in an oblique collar 13, 14 shaped as an envelope surface of a truncated cone. The collars define a funnel shape 15 extending around the circumference. The dielectric disc 10 has a thickness equal to the distance between the plates so that the space between the plates is completely filled by dielectric.

The distance disc 10 may for example be optimally dimensioned for vertically polarized radiation in which case the dielectric constant $\epsilon(r)$ follows the relationship:

$$\epsilon(r) = 2 - (r/R)^2$$

where r is the variable distance from the center of the disc and R is the outer radius of the disc.

A large number of feeders are distributed around the circumference of the round dielectric disc 10, of which only a few, designated 18, 19, 20, 21 and 22, are shown in the drawing. Of these feeders the feeder 18 is the central feeder of the feeders arranged on the front half of the disc 10, while 19, 20 are the two feeders which are closest to the feeder 18 as seen in counter clockwise direction along the circumference of the disc 10. The feeder 21 is the feeder situated maximally to the right in FIG. 1 and thus is situtated at an angle of 90° from the central feeder 18 in relation to the center of the disc 10, and the feeder 22 is situated diametrically opposite the feeder 18, i.e. in center of the rear half of the disc 10. The feeder 18 is, in FIG. 1, visible in the shape of its projection as seen in radial direction, i.e. in a direction from the center of the feeder to the center of the disc 10. This is also valid for the feeder 22, while the feeder 21 is visible in the shape of its projection from the side.

It is evident from FIG. 1 that each feeder has the shape of a thin wire which is bent (see the feeder 21 situated outermost to the right in FIG. 1) so that from the place of attachment in the lower metallic place 11 or its associated collar 13 it follows a bend 23 outwardly to a point 24, where it is folded almost 180°. It then follows a similar bend 25 inwardly to the point of attachment in the upper metal plate 12 or its collar 14. Consequently, the feeder is symmetric in relation to the point 24, although the two bent parts 23 and 25 need not be equally long. It is also evident from FIG. 1 (see the central feeder 18) that the bent parts of each feeder are situated in a plane which, as seen radially, is inclined 45° relative to the radial plane for the feeder (and also relative to the lens plane). With respect to a feeder, the expression "radial plane" is to be understood to mean the plane which coincides with center of the feeder and the central axis of the disc 10. All feeders are inclined in the same direction relative to the respective radial plane, which means that two feeders situated diametrically opposite each other always form a 90° angle with each other, as is evident from the FIG. 1 for the feeders 18 and 22.

Feeding is effected in the symmetrie point or center point 24 which for this purpose can be connected to the center lead in a coaxial cable 26, as indicated in FIG. 1 for the feeder 21. The coaxial cable must be thin and situated so that it disturbs the radiation passage as little as possible.

As a result of the inclination of the feeders the radiation from each individual feeder will be polarized 45° relative to the vertical axis (if the lens is situated horizontally). Feeders opposite each other are oriented substantially perpendicular to the polarization direction for each other and thus will produce minimal attenuation of the radiation from each other. As a result of this all feeders can be active simultaneously without any switching operation being necessary. To facilitate penetration of the horizontal component of the radiation through the lens, the distance between the conductive plates 11, 12 (taking into consideration the dielectric constant of the disc 10) must be larger than half the wavelength for the lowest frequency.

Figure 3:
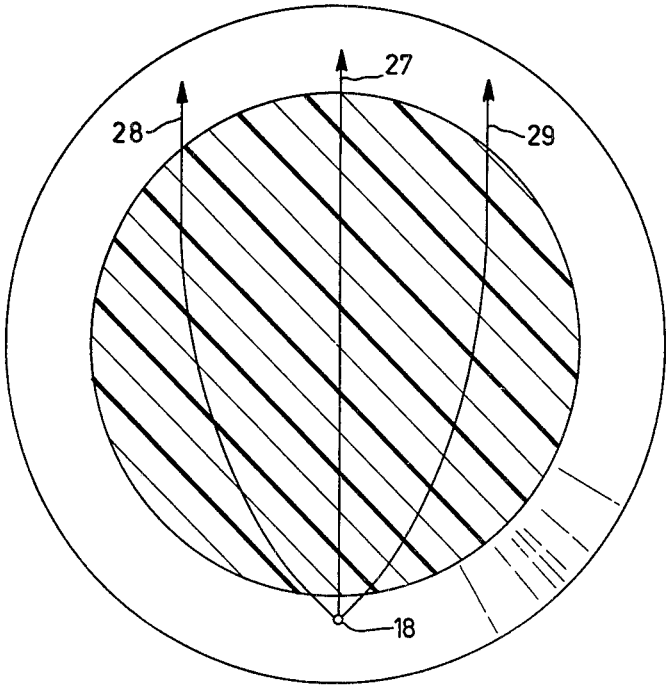
FIG. 3 shows a horizontal sectional view taken along the line III—III in FIG. 1 without feeders and with three radiation paths shown.

The shape and the dimensioning of each individual feeder must be made such that the required lobe width is achieved for the emerging radiation beam. FIG. 3 shows the central ray for the feeder 18 represented by the line 27 and two of the outer rays 28, 29 of the main lobe. As shown, the outermost parts of the lens are not utilized. The reason for this is i.a. that those feeders which are situated at the outermost parts have an inclination against the polarization direction, which deviates essentially from 90°, and the feeders situated at these parts therefore should produce an essential attenuation.

An advantage with the illustrated symmetric arrangement of the feeders is that higher modes are suppressed. However, the feeders may in principle also be shaped in another suitable manner within the scope of the invention, for example they might have the shape of a wire or a wire loop which is fed in one end. One of the conductive planes may if desired also be omitted, in which case certain leakage radiation occurs in the direction where the conductive plane is missing.

Figure 4:
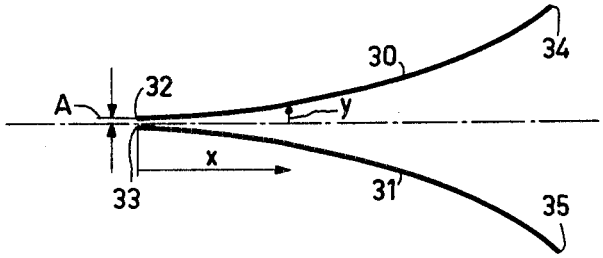
FIG. 4 shows a side view of a preferred shape of the dipole feeders.

FIG. 4 shows a preferred shape of the dipole feeders, in which the legs 30, 31 of the dipole are bent to a curve satisfying the equation:

$$y = \pm A \cdot e^{px}$$

where y and x are defined as shown in the figure and A and p are constants. Feeding is effected at points 32 and 33 and the free ends 34, 35 are preferably electrically coupled to the upper and lower conductive plane, respectively.

Figure 5:
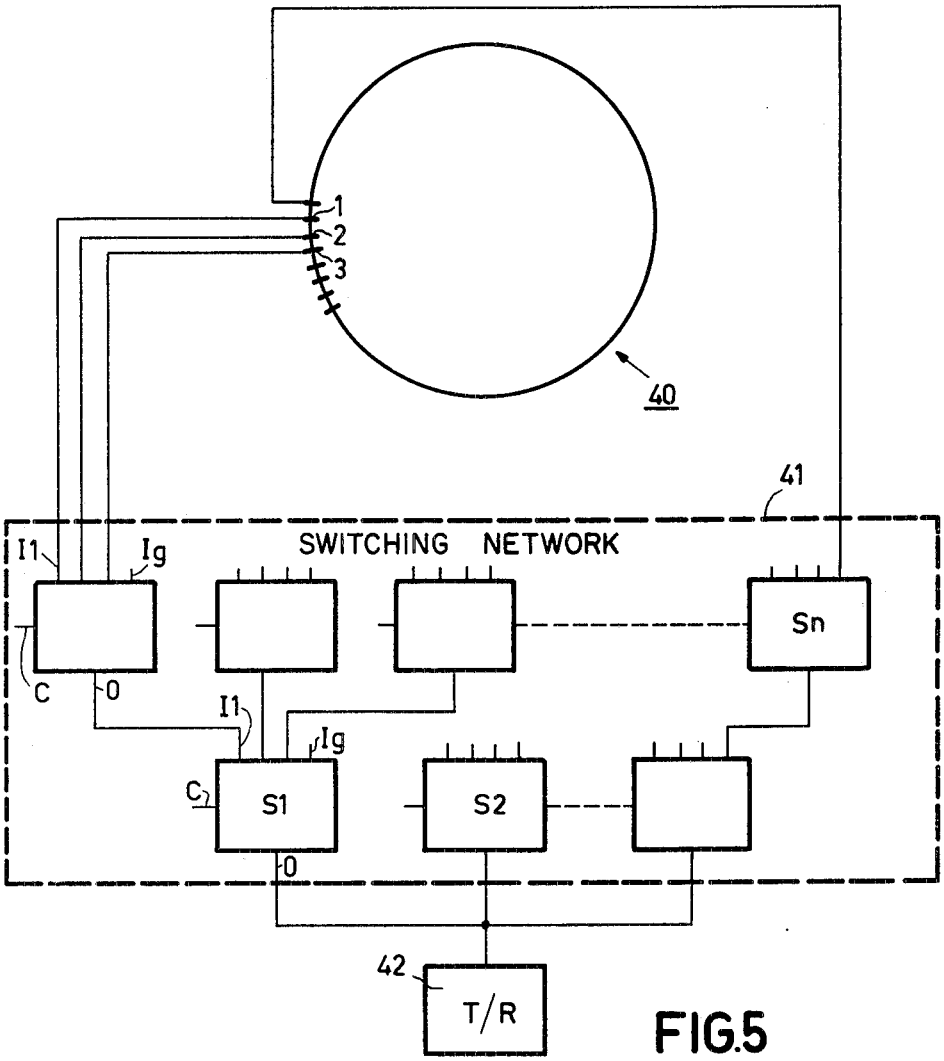
FIG. 5 shows schematically a lens antenna according to the foregoing figures and switching means for selective activation of the feeders by connecting them to a transmitter/receiver.

FIG. 5 shows schematically an antenna arrangement comprising a lens antenna 40 of the above-described kind with feeders 1, 2, 3 . . . distributed in close mutual relationship round the whole circumference and a switching network 41 for selectively connecting any feeder 1, 2, 3 . . . to a transmitter/receiver 42. The exemplary switching network 41 comprises a number of identical switching units S1, S2 . . . Sn arranged in two rows. Each switching unit S1, S2 . . . Sn has one signal output 0, a number of signal inputs T1 . . . Ig and a control input C. In operation the switching units, which can be diode switches or multiplexers, are adapted to establish connection between the signal output and one of the signal inputs in dependence on a control signal applied to the control input. The outputs of the switching units in the first row are connected to the transmitter/receiver 42, while the signal inputs of the switching units in the first row are each connected to the signal output of a switching unit in the second row, and the signal inputs of the switching units in this second row are connected to the individual feeders. It is apparent from the drawing that each feeder, alone or in combination with other feeders, can be connected to the transmitter/receiver by applying suitable control signals to the control inputs of the switching units.

What is claimed is:

1. A lens antennas arrangement, operable within the microwave range, comprising a round disc-shaped lens element with a radially varying refraction index, covered on at least one of the major sides by a conductive plane, and including feeders located at the circumference for reception or transmission of electromagnetic energy passing through the disc-shaped lens element, characterized in that the feeders are directive dipole feeders distributed around the circumference of the lens element, said dipole feeders being shaped such that each feeder has a limited lobe directed diametrically through the lens element, and that each dipole feeder is located in a plane which is inclined approximately 45° relative to the lens plane, all feeders—as seen radially for each individual feeder—being inclined in the same direction so that each feeder is polaraized substantially orthogonally relative to the plane of the feeder situated diametrically opposite thereto, switching means being electrically-connected between the feeders and means for selectively activating the feeders.

2. An antenna arrangement as in claim 1, characterized in that the dipole feeders are V-shaped, with the apex of the V directed outwardly from the lens circumference.

3. An antenna arrangement as in claim 2, in which conductive planes are provided at both major sides of the lens element, characterized in that each free end of the V-shaped dipole feeders is electrically coupled to a respective conductive plane.

4. An antenna arrangement as in claim 2 or 3, characterized in that each feeder is of substantially symmetric shape in its plane, a line through the apex of the V forming a symmetry line, and feeding is effected at the apex.

5. An antenna arrangement as is claim 4, characterized in that legs of the V are bent to concave shape as seen from the outside of the V.

6. An antenna arrangement as in claim 5, characterized in that the legs of each dipole V-shaped feeder are bent to an exponential curve substantially satisfying an equation:

$$y = \pm A \cdot e^{px}$$

where y is the distance from the symmetry line, passing through the apex of the V, to the respective leg, x is the distance along the symmetry line from the apex, and A and p are constants.

* * * * *